United States Patent [19]

Jackson et al.

[11] Patent Number: 4,712,667

[45] Date of Patent: Dec. 15, 1987

[54] DEVICE FOR RECOVERING FLUID FROM A WELL

[76] Inventors: Owen E. Jackson, 7501 E. McCormick Pkwy., Ste. 207, Scottsdale, Ariz. 85258; Thomas W. Donaldson, 2460 Lemon Ave., Signal Hill, Calif. 90806

[21] Appl. No.: 716,343

[22] Filed: Mar. 26, 1985

Related U.S. Application Data

[63] Continuation-in-part of Ser. No. 573,022, Jan. 23, 1984, abandoned.

[51] Int. Cl.[4] ..... B65G 15/00

[52] U.S. Cl. ..... 198/643; 198/496; 198/497; 417/320

[58] Field of Search ..... 198/643, 702, 496, 497, 198/730; 417/320; 418/4; 474/92

[56] References Cited

U.S. PATENT DOCUMENTS

| | | | |
|---|---|---|---|
| 769,014 | 8/1904 | Pedley | 198/643 |
| 831,448 | 9/1906 | Leinweber | 198/643 |
| 930,465 | 11/1908 | Fowler | 198/643 |
| 1,007,282 | 10/1911 | Hawley | 198/643 |
| 1,017,847 | 2/1912 | Carl | 198/643 |
| 1,221,018 | 4/1917 | Bliss | 198/643 |
| 1,245,427 | 11/1917 | Bliss | 198/643 |
| 1,425,112 | 8/1922 | Long | 198/643 |
| 1,475,382 | 11/1923 | Gennevois | 198/643 |
| 1,499,386 | 7/1924 | Long | 198/643 |
| 1,499,387 | 7/1924 | Long | 198/643 |
| 1,703,963 | 3/1929 | Scruby | 198/643 |
| 2,380,144 | 7/1945 | Bohannon | 198/643 |
| 2,704,981 | 3/1935 | Gustafson | 198/643 |
| 3,774,685 | 11/1973 | Rhodes | 198/643 |

FOREIGN PATENT DOCUMENTS

| | | | |
|---|---|---|---|
| 440536 | 2/1912 | France | 417/320 |

*Primary Examiner*—Robert J. Spar
*Assistant Examiner*—Jonathan D. Holmes
*Attorney, Agent, or Firm*—Lyon & Lyon

[57] ABSTRACT

An endless chain of link members having oil accumulating cavities disposed therein is circulated in a well at a controlled rate carrying oil to the surface where same is dumped and removed by brush and wipers.

2 Claims, 10 Drawing Figures

DEVICE FOR RECOVERING FLUID FROM A WELL

The present application is a continuation in part of U.S. patent application Ser. No. 573,022 filed on Jan. 23, 1984, now abandoned.

BACKGROUND OF THE INVENTION

The field of the present invention is the recovery of fluid from wells.

The conventional method of removing oil from a well is by a pump. Many wells either because of the low rate of flow, the high viscosity of the fluid or for other reasons are unpumpable or uneconomical to pump. Alternate methods of extraction have been proposed such as an endless belt in Rhodes U.S. Pat. No. 3,774,685 and Pedley U.S. Pat. No. 769,014, an endless chain with absorbent material in Hawley U.S. Pat. No. 1,007,282 or an endless chain in Gustafson U.S. Pat. No. 2,704,981.

The instant invention improves upon such suggestions by providing oil carrying cavities in an endless link chain which is driven at variable speeds to accommodate well conditions.

SUMMARY OF THE INVENTION

This invention relates to a device for recovering oils over a wide range of specific gravity from deep or shallow wells.

In many wells productivity is reduced to an uneconomic level where the viscosity of the fluid is too high and the rate of flow too low. Many such wells are unpumpable or uneconomical and shut down as a result.

It is therefore an object of this invention to provide improved means for extracting oil from wells which are otherwise uneconomical or unpumpable at an economical rate.

It is another object of this invention to provide increased oil extracting capacity in a chain used to recover fluid from wells.

It is a further object of this invention to provide means by which the rate of extraction of oil can be regulated to the productivity of the well to prevent well drawdown.

It is still a further object of this invention to provide a lift apparatus that is independent of the physical properties of the oil being pumped such as its viscosity, sand content, chemical composition, wetting and adhesion characteristics.

Other objects and advantages will be readily apparent from the following description.

DESCRIPTION OF THE PREFERRED EMBODIMENT

Figures 1, 2, 3:
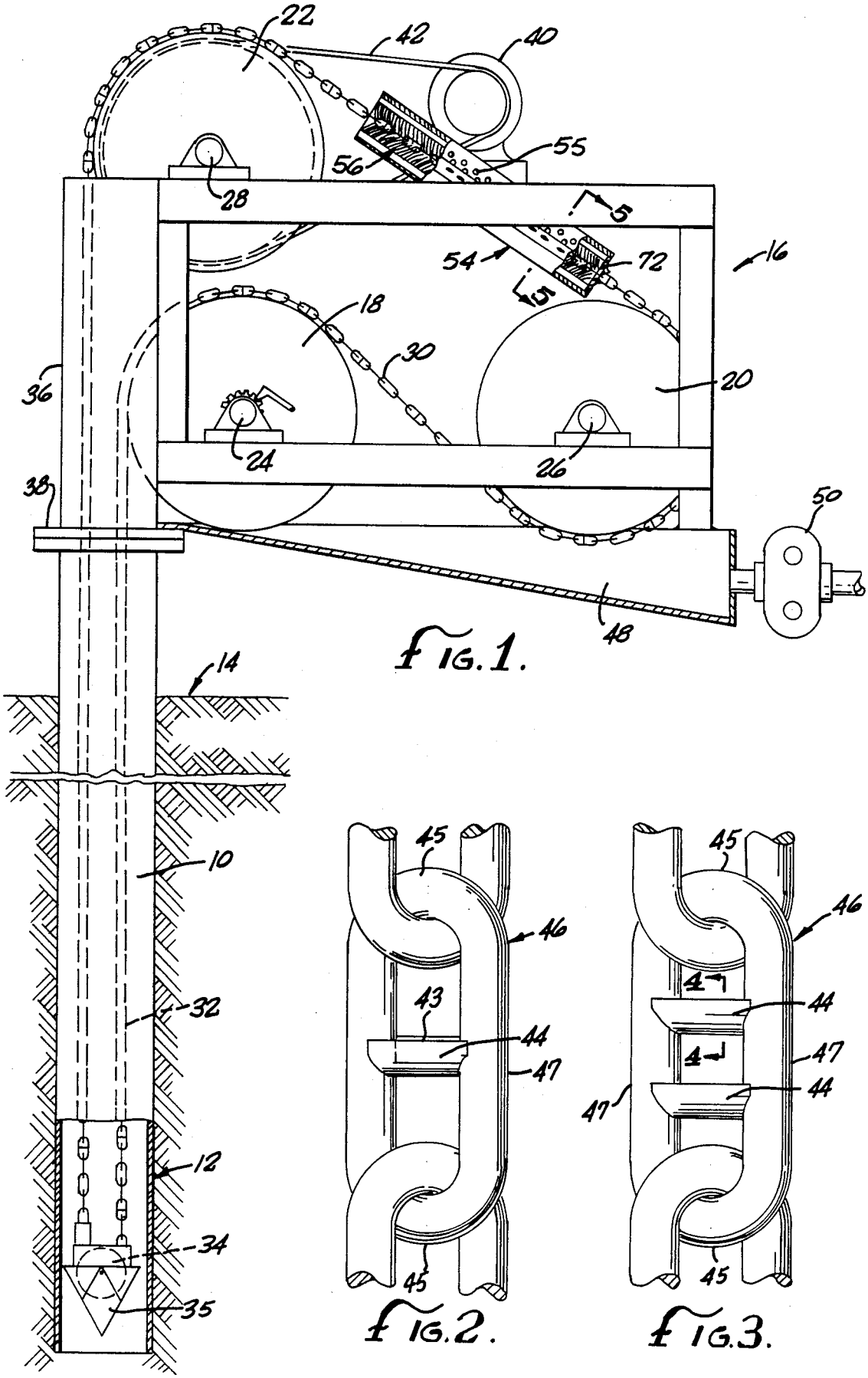
FIG. 1 is a side elevation of the system embodying this invention.
FIG. 2 is a perspective of a chain link member employing a single oil carrying cavity.
FIG. 3 is a perspective of a chain link member employing two oil carrying cavities.

Referring to FIG. 1, a well 10 may have the usual casing 12 projecting above ground level 14. A platform 16 is supported in any acceptable fashion above the ground level and has a series of sprockets 18, 20 and 22 journalled on shafts 24, 26 and 28 respectively, which shafts are rotatably supported in platform 16 in the usual manner.

An endless chain 30 is looped around sprockets 18, 20 and 22. Said chain has a loop 32 which hangs inside casing 12 and passes around a downwell idler sprocket 34 that carries weight 35 to hold the loop down the well. A pipe extension 36 preferably of the same size as the oil well casing 12 is mounted above same and attached to it by flange 38 and surrounds endless chain 30. The main drive pulley 22 is driven by a variable speed motor 40 through belt 42. By varying the speed of motor 40 the rate of extraction of oil from the well can be controlled to the rate of migration from the surrounding productive zone thereby avoiding too rapid extraction.

Figure 4:
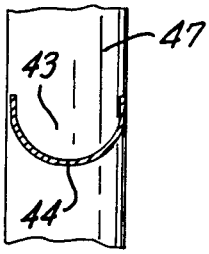
FIG. 4 is a cross-sectional view of a bucket and associated oil carrying cavity taken along line 4—4 of FIG. 3.
Figure 9:
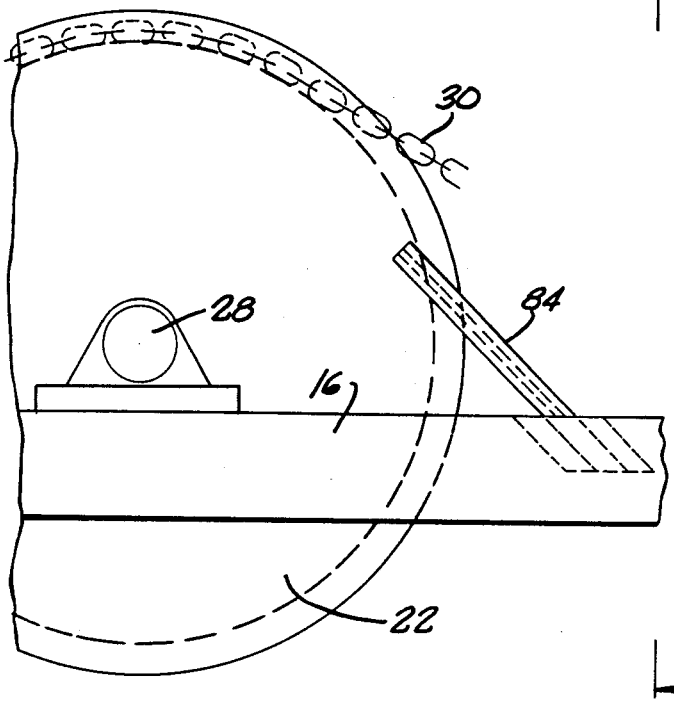
FIG. 9 is a truncated side view of a main drive sprocket and a sprocket cleaning blade.
Figure 10:
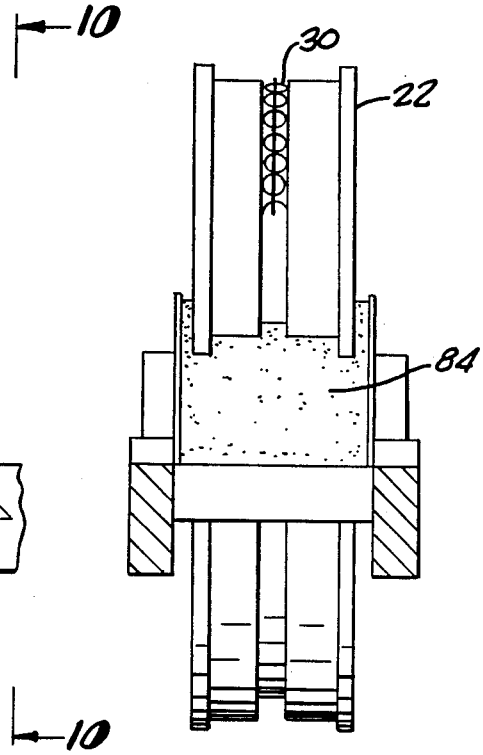
FIG. 10 is an end view of a main drive sprocket and a sprocket cleaning blade.

Referring to FIGS. 2, 3 and 4, buckets 44 formed from sheet stock of suitable thickness are mounted within one or more link members 46 of the endless chain 30 to form oil carrying cavities 43. While the shape of these buckets may vary, in the embodiment shown they are U-shaped and have ends thereof affixed to opposite sides 47 of link members 46 in any acceptable manner, for example soldered or brazed. While the size of cavities 43 may vary, in the present embodiment the buckets 44, as viewed in FIG. 4, are no wider than the diameter of the link sides 47 lest they impact sprockets 18, 20, or 22. As the driven sprocket 22 rotates clockwise in FIG. 1 the chain link members 46 rise through the well such that cavities 43 fill with oil, causing the oil to be raised to the surface. As each link member 46 progresses over sprocket 22, it turns from a carrying position to a dumping position. The oil carried up in the cavities 43 falls downwardly into a collecting trough 48 and by means of a pump 50 is removed. Because some of the oil removed from chain 30 may remain on drive sprocket 22, sprocket cleaning blade 84, as shown in FIGS. 9 and 10, is suitably mounted on platform 16 and positioned to scrape excess oil buildup from sprocket 22 and transfer same into collecting trough 48. Sprocket cleaning blade 84 may be constructed of any suitable material such as oil and abrasion resistant rubber or the like.

Figure 5:
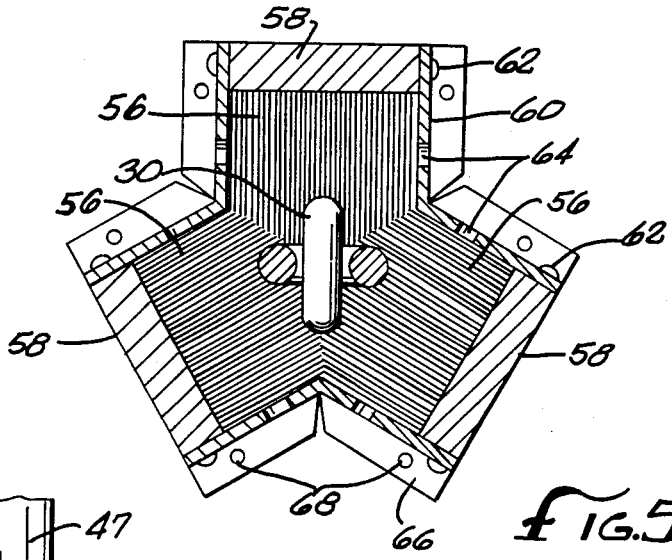
FIG. 5 is a cross-sectional view of a brush housing taken along line 5—5 of FIG. 1.
Figure 6:
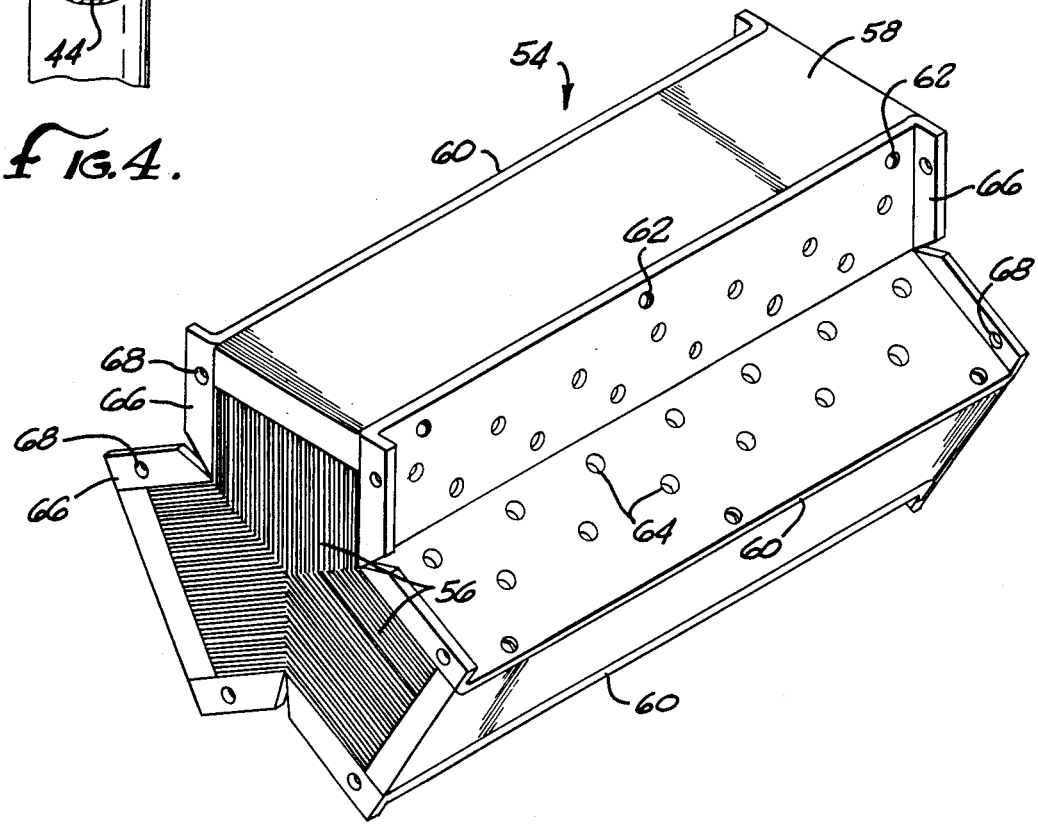
FIG. 6 is a projection view of a brush housing.

In order to facilitate oil removal from the chain 30 brush housing 54 may be employed. Referring to FIGS. 1, 5 and 6, housing 54 is suitably mounted in platform 16. Brushes 56 of any suitable type are mounted in housing 54. Housing 54 comprises base members 58 to which brushes 56 are mounted and positioning plates 60 which position brushes 56 to form a bristle-filled cavity. As the chain 30 passes between the brushes, through the bristle-filled cavity, brushes 56 scrub oil from the buckets and chain links which then drops into trough 48. As shown in FIGS. 5 and 6, three brushes 56 are mounted to corresponding base members 58 which are in turn supported by three positioning plates 60 such that the bristles of any one brush are oriented approximately 120 degrees from the bristles of the other two brushes when viewed along the chain axis. Base members 58 are secured to plates 60 by any acceptable fastening means such as screws 62 or the like. Positioning plates 60 are provided with perforations 64 to permit the removed oil to pass exteriorly from the bristle-filled cavity, which oil then drops into collecting trough 48.

Figure 7:
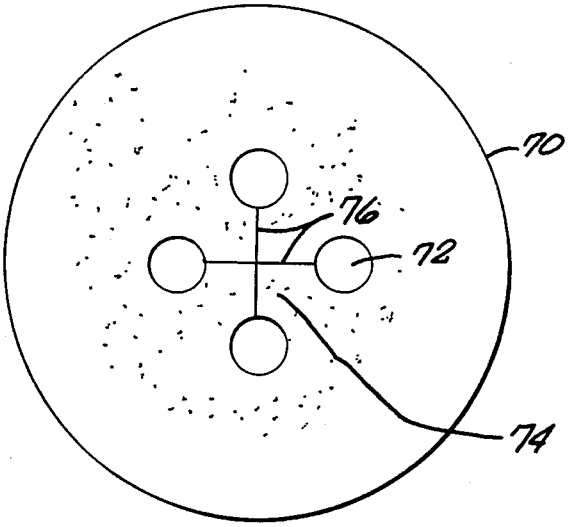
FIG. 7 is a plan view of an oil wiper.
Figure 8:
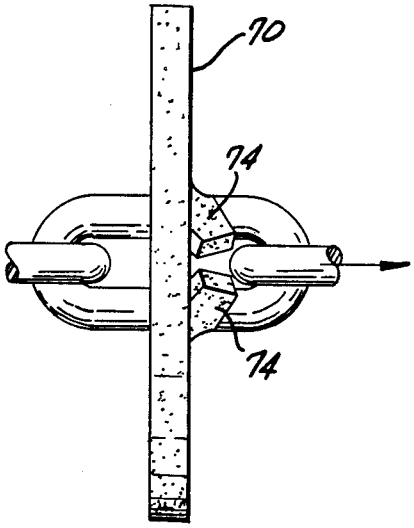
FIG. 8 is an edge view of an oil wiper.

To further facilitate the collection of the oil thus recovered from the well a fixed oil resistant wiper 70 may be utilized. Preferably, wiper 70 is a flexible plate made from oil resistant rubber or the like as shown in FIGS. 7 and 8. In the present embodiment wiper 70 is ¼" to ½" thick and is mounted in housing 54 to flanges 66 of brush positioning plates 60, preferably by conventional fastening means through flange holes 68.

Referring to FIGS. 7 and 8, wiper 70 features pairs of holes 72 positioned to permit the sides 47 of chain link members 46 to pass therethrough. To permit the ends 45 of link members 46 to pass freely through wiper 70 movable flaps 74 formed by intersecting crosscuts 76 extending between respective pairs of holes 72 are provided. As shown in FIG. 8, as chain link end 45 passes through wiper 70, flaps 74 yield to the extent necessary to accommodate the link while bearing on the link to wipe fluid therefrom. Once end 45 has passed wiper 70, flaps 74 will spring back into the plane of the wiper to reform holes 72. As shown in FIG. 8, the link members 46 comprise a largest transverse dimension and a smallest transverse dimension. Each pair of holes 72 are spaced from each other an amount substantially equal to the largest transverse dimension of the link member 46. Holes 72 have a diameter corresponding to the smallest transverse dimension of the link members 46. In this manner, substantially all of the fluid carrying surfaces of the link members 46 will be wiped of fluid.

Buckets 44 and associated cavities 43 may be provided in the quantity desired such as two per link member as shown in FIG. 3, or even more. Similarly, depending upon the productivity of the well, they may be used in every second or third link member or less frequently.

Thus by controlling the number of oil carrying cavities disposed in the chain link members, and the speed of rotation of the driven sprocket 22, the rate of pumping from the well can be controlled to accommodate well conditions. Further, if necessary, sprockets 18 and 20, which are shown here as idling, may be driven by additional motors such as motor 40 should such additional drive be required.

In a similar vein, it will be appreciated that the number of brushes utilized in any particular brush housing may vary. Further, several brush housings may be arranged serially on the chain. Likewise, several wipers may be positioned on the chain as required.

While what hereinbefore has been described is the preferred embodiment of this invention, it is readily apparent that other alterations and modifications can be resorted to without departing from the scope of this invention and such alterations and modifications are intended to be included within the scope of the appended claims.

What is claimed is:

1. A device for recovering fluid from a well comprising:

an endless chain of rigid link members adapted to be suspended down a well, drive means for moving said chain through said well, a wiper through which said chain passes, said wiper comprising a flexible plate, said plate having pairs of holes, the holes of each said pair being spaced a distance from each other an amount substantially equal to the largest transverse dimension of said link members and said holes having a diameter corresponding to the smallest transverse dimension of said link members, whereby said holes wipe the sides of said link members, said wiper further having movable flaps defined by intersecting cross cuts each extending between a respective pair of said holes, whereby said flaps wipe the ends of said link members.

2. A wiper device for recovering fluid from a chain rigid of link members comprising:

a plate formed of flexible material, pairs of holes disposed in said plate, the holes of each said pair being spaced a distance from each other an amount substantially equal to the largest transverse dimension of the link members and said holes having a diameter corresponding to the smallest transverse dimension of the link members, whereby said holes wipe fluid from the sides of the link members, movable flaps defined by intersecting cross cuts extending between respective pairs of said holes, whereby said flaps wipe the ends of said link members.

* * * * *